US007700158B2

(12) United States Patent
Truong

(10) Patent No.: US 7,700,158 B2
(45) Date of Patent: Apr. 20, 2010

(54) METHOD OF PRINTING AN IMAGE ON A METALLIC SURFACE, PARTICULARLY ON A COIN SURFACE

(75) Inventor: Hieu C. Truong, Nepean (CA)

(73) Assignee: Royal Canadian Mint, Ottawa, Ontario (CA)

( * ) Notice: Subject to any disclaimer, the term of this patent is extended or adjusted under 35 U.S.C. 154(b) by 1389 days.

(21) Appl. No.: 10/969,410

(22) Filed: Oct. 20, 2004

(65) Prior Publication Data

US 2006/0081144 A1 Apr. 20, 2006

(51) Int. Cl.

| | |
|---|---|
| ***G09F 3/02*** | (2006.01) |
| ***A44C 21/00*** | (2006.01) |
| ***B05D 5/04*** | (2006.01) |
| ***B05D 5/06*** | (2006.01) |
| ***B05D 5/02*** | (2006.01) |
| ***B05D 1/36*** | (2006.01) |
| ***B05D 3/00*** | (2006.01) |

(52) U.S. Cl. ..... 427/327; 427/256; 427/261; 427/264; 427/270; 427/275; 427/287; 427/289; 427/290; 427/307; 40/27.5; 428/577; 428/579

(58) Field of Classification Search ..... 427/256–290, 427/299, 307, 327; 40/27.5; 428/577, 579
See application file for complete search history.

(56) References Cited

U.S. PATENT DOCUMENTS

| | | | | |
|---|---|---|---|---|
| 2,812,295 | A * | 11/1957 | Patrick | 205/124 |
| 2,990,304 | A * | 6/1961 | Cybriwsky et al. | 148/244 |
| 5,139,886 | A * | 8/1992 | Truong et al. | 428/577 |
| 5,774,774 | A | 6/1998 | Tamura et al. | 399/302 |
| 5,994,264 | A | 11/1999 | Sherman et al. | 503/227 |
| 6,198,898 | B1 | 3/2001 | Mabbott | 399/302 |
| 6,244,700 | B1 * | 6/2001 | Kimura et al. | 347/102 |

(Continued)

FOREIGN PATENT DOCUMENTS

EP 0 209 896 A2 7/1986

(Continued)

OTHER PUBLICATIONS

McNaught et al., [online version] IUPAC Compedium of Chemical Terminology, *Royal Society of Chemistry*, Cambridge, UK, Second Edition 1997, May 19, 2009, pp. 3-8.

*Primary Examiner*—Timothy H Meeks
*Assistant Examiner*—Cachet I Sellman
(74) *Attorney, Agent, or Firm*—Drinker Biddle & Reath LLP

(57) ABSTRACT

A method of printing on a metal surface includes steps of forming a plurality of macropores on at least a portion of a metal surface. A plurality of micropores are formed within and adjacent to the macropores. The metal surface is cleaned, and a first ink having a first color is applied to the macropores and micropores to form at least one image on the metal surface. Preferably, the ink is applied using an inkjet printer. The ink is dried. A second ink having a second color may also be applied to the metal surface and then dried. Additional inks may also be applied. A lacquer top coat may be applied to the metal surface on top of the first ink (and additional inks, if provided). Preferably, the metal surface is part of a coin.

23 Claims, 5 Drawing Sheets

U.S. PATENT DOCUMENTS

| | | | | |
|---|---|---|---|---|
| 6,517,374 | B2 * | 2/2003 | Maeda | 439/417 |
| 6,753,080 | B1 * | 6/2004 | Sebastian et al. | 428/364 |
| 6,773,496 | B2 * | 8/2004 | Doyle et al. | 106/31.61 |
| 2002/0090456 | A1 * | 7/2002 | Mackey et al. | 427/258 |
| 2004/0194235 | A1 | 10/2004 | Yan | |

FOREIGN PATENT DOCUMENTS

| | | | |
|---|---|---|---|
| EP | 1 084 830 | A1 | 9/1999 |
| EP | 1 120 248 | A2 | 1/2001 |
| EP | 1120248 | A2 * | 8/2001 |
| EP | 1 629 977 | A2 | 8/2005 |
| GB | 2 373 217 | A | 3/2002 |
| WO | WO 01/92025 | A1 | 5/2001 |

* cited by examiner

METHOD OF PRINTING AN IMAGE ON A METALLIC SURFACE, PARTICULARLY ON A COIN SURFACE

FIELD OF THE INVENTION

The invention relates to printing generally and more particularly to printing on metal objects such as coins.

BACKGROUND OF THE INVENTION

It is known to print images on metal substrates. Typically, it is necessary to coat the metal substrate with a thermoplastic or thermoset material prior to application of ink. It is further known to transfer the ink first to an intermediate carrier and subsequently transfer the ink from the carrier to the coated substrate. See, for example, U.S. Pat. No. 5,994,264 (Sherman et al.).

In particular, it is known to apply paint or ink to a metal coin using a silk screen process. While high quality images may be produced by such processes, adhesion of the image to the coin surface is not adequate to provide sufficient durability to make such coins suitable for public circulation.

A need exists for an efficient and low-cost method of printing images on metal surfaces such that the image demonstrates good adhesion to the metal surface. There is a particular need for a method of printing images on a face of a metal coin, wherein the image demonstrates sufficient durability to make the printed coin suitable for public circulation.

SUMMARY OF THE INVENTION

In a first aspect, the invention is a method of printing on a metal surface comprising the steps of providing a metal surface, forming a plurality of macropores on at least a portion of the metal surface, and forming a plurality of micropores within the macropores. The metal surface is cleaned, and a first ink having a first color is applied to the macropores and micropores to form at least one image on the metal surface. The ink is dried.

Preferably, the metal surface is part of a coin. Additional inks may be applied. Preferably, the first ink and any additional inks are solvent-based and are applied using inkjet printers. The drying process is preferably accomplished by blowing air across the metal surface. The method further preferably comprises a step of inspecting the metal surface to ensure correct orientation of the metal surface and a step of inspecting the metal surface to ensure proper quality of the printed image. The method may include a step of applying a substantially transparent top coat over the first and any additional inks. Preferably, the macropores are in the range of about 0.1 to 0.5 millimeter across and in the range of about 0.01 to 0.05 millimeter deep and the micropores are in the range of approximately 0.01 microns to 15 microns deep. The macropores may be formed in a stamping operation and the micropores may be formed in a sandblasting operation.

In a second aspect, the invention is a method of printing an image on at least a portion of a coin surface. The method comprises a first step of providing a metal coin having a first side and a second side. A plurality of macropores are formed on at least a portion of the first side. A plurality of micropores are formed at least within the macropores. At least the first side is cleaned to provide a substantially clean surface. The first side is inspected to ensure correct orientation of the coin. A first inkjet printer is used to apply a first ink having a first color to the macropores and micropores to form a first image on the first side. The first ink is air dried. A second inkjet printer is used to apply a second ink having a second color to the macropores and micropores. The second ink is air dried. A top coat of lacquer is applied to cover the first and second inks using a third inkjet printer. The top coat is air dried. The method is not limited to two colors, but may involve only one color, or more than two colors, excluding the top coat.

BRIEF DESCRIPTION OF THE DRAWINGS

For the purpose of illustrating the invention, there is shown in the drawings a form of the invention which is presently preferred; it being understood, however, that this invention is not limited to the precise arrangements and instrumentalities shown. In the drawings.

DETAILED DESCRIPTION OF THE DRAWINGS

Figure 1:
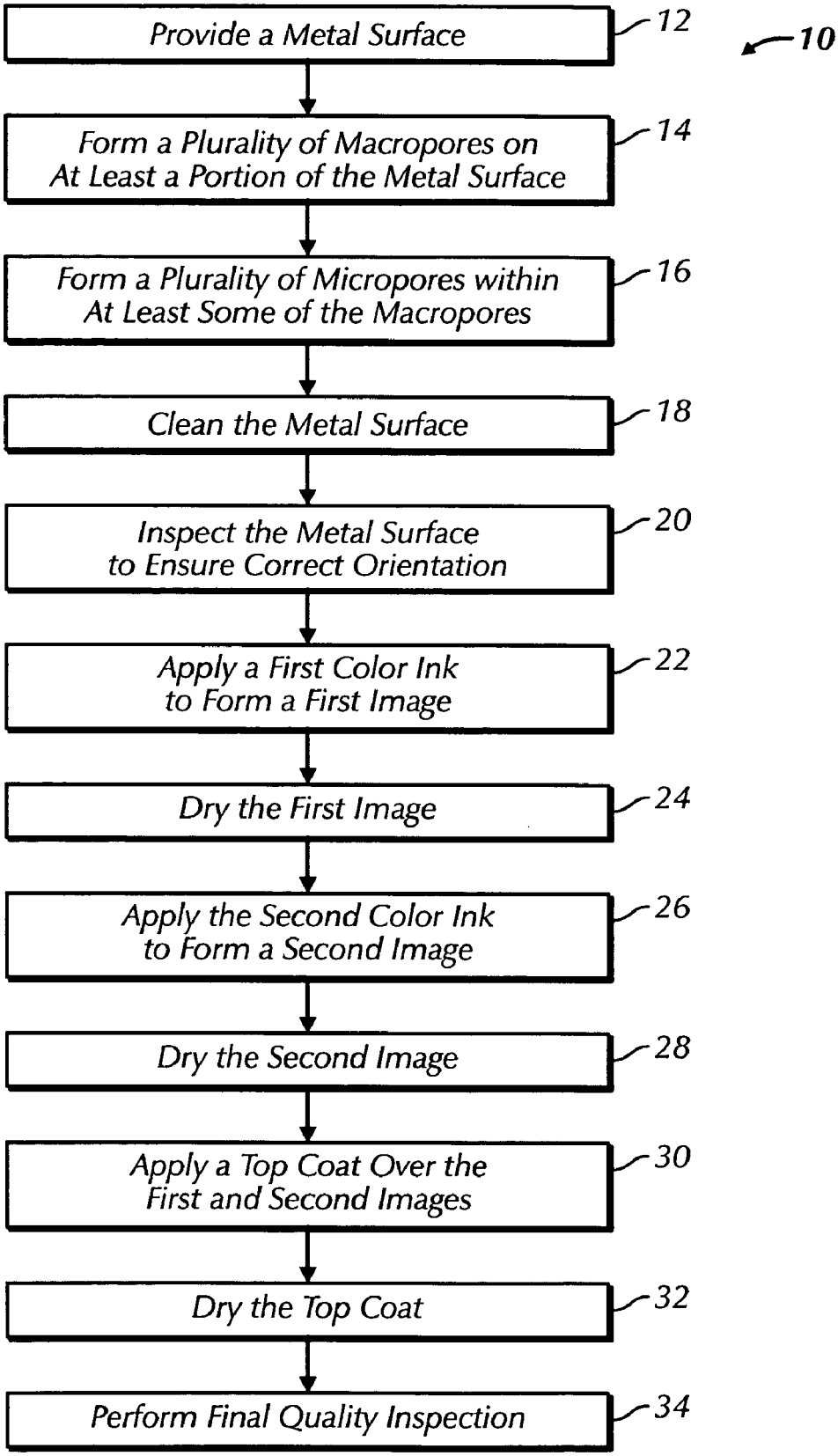
FIG. 1 is a diagram of the steps of a method of printing on a metal surface in accordance with the present invention.
Figure 2:
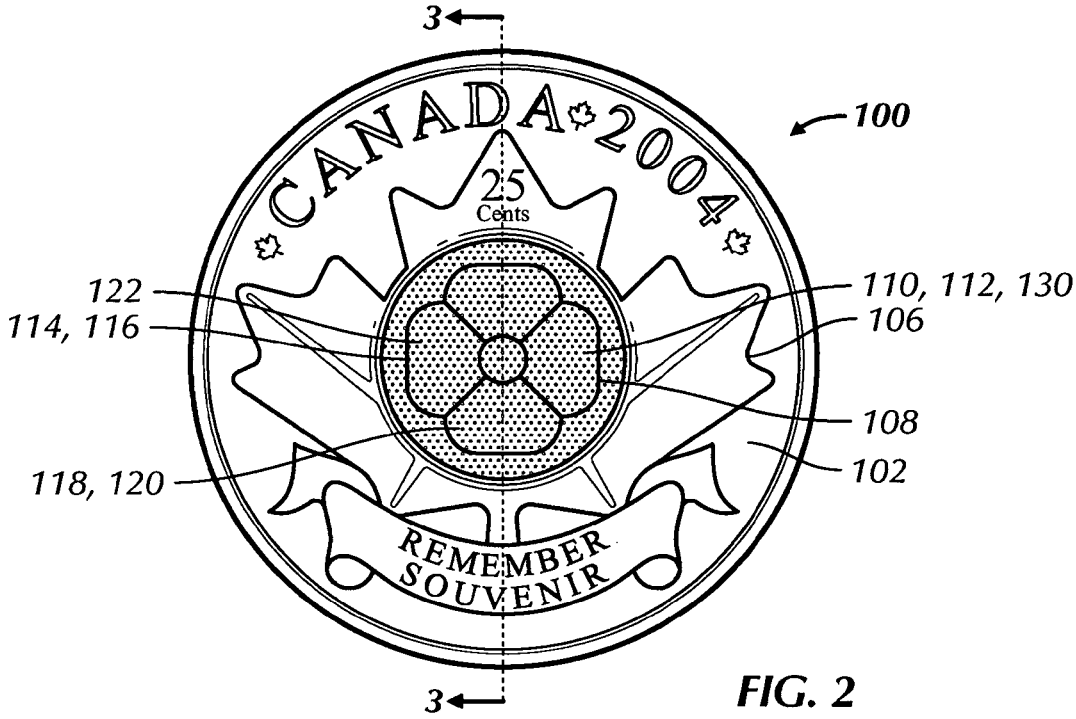
FIG. 2 is a plan view of a first side of a coin having a printed surface produced in accordance with the method of FIG. 1.
Figure 3:
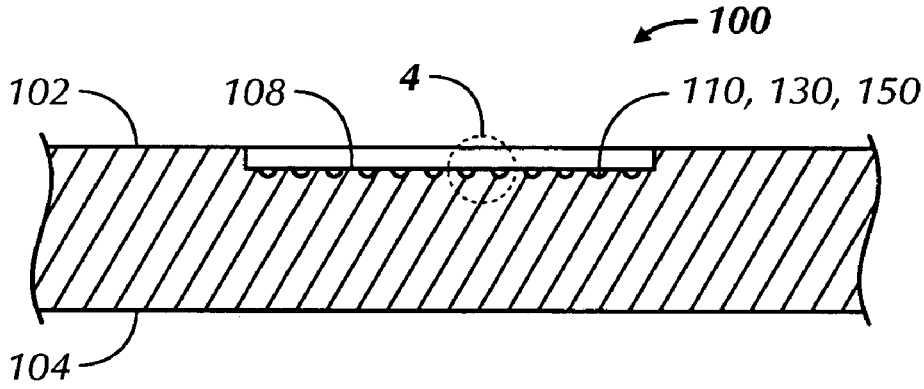
FIG. 3 is a cross-sectional view of the coin of FIG. 2, taken along line 3-3 of FIG. 2.
Figure 4:
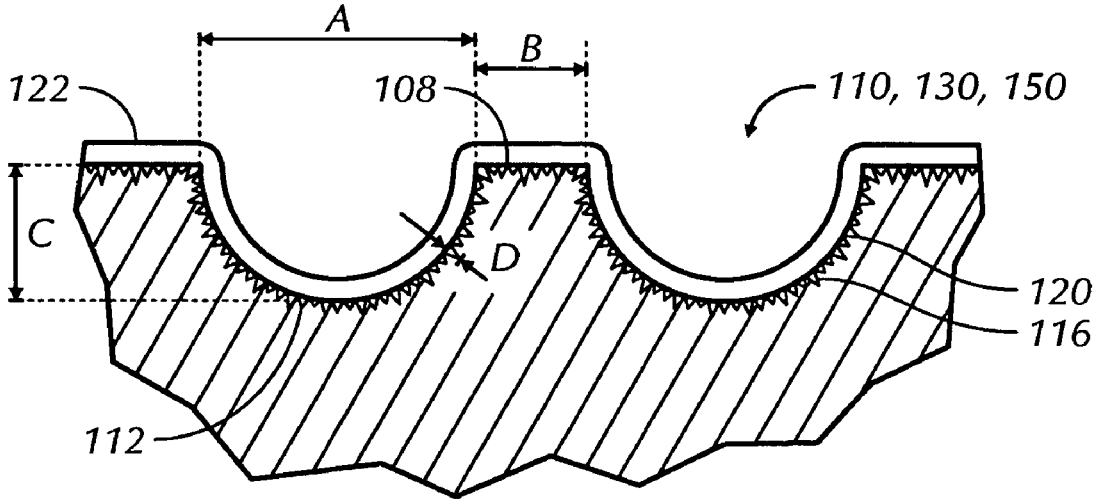
FIG. 4 is an enlarged detail view of the printed surface of the coin of FIG. 2, showing macropores and micropores produced in accordance with the method of FIG. 1.

Referring to the figures, wherein like numerals are used to indicate like elements throughout, there is shown in FIG. 1 a diagram of the steps of a method, identified generally by reference numeral 10, of printing on a metal surface in accordance with the present invention. FIGS. 2-4 illustrate a coin 100 produced by the method 10. The coin 100 includes a printable surface 108 having a plurality of macropores 110 and micropores 112, described in detail below. FIGS. 5-15 illustrate a few of the various ways in which the macropores 110 may be constructed.

The method of printing on a metal surface 10 will be described in the context of producing the coin 100. However, it will be recognized that the method 10 is applicable to metallic surfaces generally, and is not limited in application to coins. The method 10 is, however, especially well-suited for providing printed images on coins.

With reference to FIGS. 1-4, the method 10 comprises a first step 12 of providing a metal surface. The metal surface may be, for example, a first side 102 of the metal coin 100. The metal coin 100 includes the first side 102 and a second side 104. In the preferred embodiment illustrated, the first side 102 is provided with embossed indicia 106 surrounding the printable surface 108.

Figure 14:
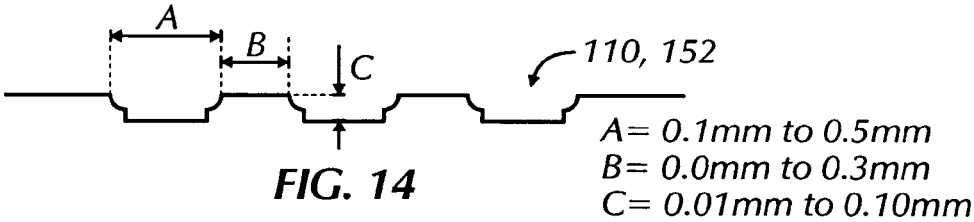
FIGS. 14 and 15 are cross-sectional views showing alternative macropore construction in accordance with the method of FIG. 1.
Figure 15:
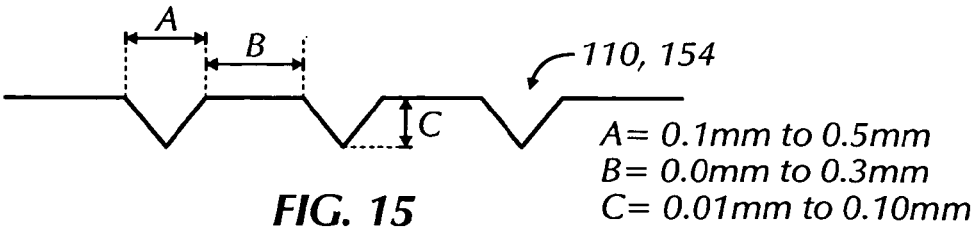

In a second step 14, a plurality of macropores 110 are formed on at least a portion of the metal surface (preferably, the first side 102). Preferably, the macropores 110 are formed using conventional metalworking techniques, such as stamping. With reference to FIGS. 4, 14, and 15, the macropores preferably have a width A in the range of approximately 0.1 to 0.5 millimeters and a depth C in the range of 0.01 to 0.10 millimeters. Preferably, the macropores 110 are separated from one another by a distance B in the range of 0.0 to 0.3 millimeters.

Figure 5:
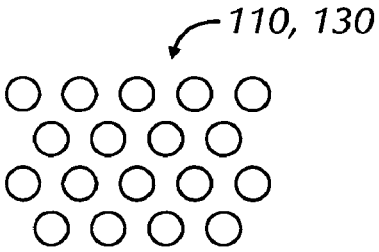
FIGS. 5 through 13 are plan views of alternative patterns of macropore construction in accordance with the method of FIG. 1.

The macropores 110 may be formed in a wide array of patterns. With reference to FIGS. 4 and 5, in a first pattern 130, the macropores 110 are formed as separate generally circular indentations of a generally uniform diameter. With reference to FIGS. 6-13, second through ninth patterns 132-146 provide both discrete, localized indentations similar to the first pattern 130, as well as extended indented channels. Other patterns are possible.

Furthermore, the macropores 110 may be formed in a wide array of cross-sectional profiles. With reference again to FIGS. 4 and 5, in a first cross-sectional profile 150, the macropores 110 are provided with a semi-circular cross-sectional profile. Furthermore, and with reference to FIG. 14, in a second cross-sectional profile 152, the macropores 110 may be provided with compound shape having a combination of radiused and linear edges. Still further, with reference to FIG. 15, the macropores 110 may be provided with a third, generally triangular, cross-sectional profile 154. The first through third cross-sectional profiles are illustrative of only three of the many geometries possible.

With particular reference to FIGS. 1 and 4, in a third step 16 a plurality of micropores 112 are formed within and adjacent to the macropores 110. The micropores 112 are characterized by dimensions much smaller than the macropores, ranging in sizes (depth and breadth) from 0.01 micron (micromillimeter) to 15 microns. The micropores 112 average in size from around 0.5 micron to 5.0 microns. The micropores 112 are preferably produced by a sandblasting process or by a lasering process.

With continued reference to FIG. 1, in a fourth step 18 the metal surface (preferably, the printable surface 108) is cleaned to remove any debris on the surface accumulated during processing, including any lubricants. A clean surface improves adhesion of ink subsequently applied to the surface. The surface is cleaned using conventional techniques known to those of ordinary skill in the art of metalworking.

Preferably, in a fifth step 20 the metal surface is inspected to ensure correct orientation of the metal surface relative to inkjet printing equipment, described further below. The fifth step 20 is necessary for objects such as the coin 100, which is preferably fed to the printing equipment by automated equipment, and which is fed to the printing equipment oriented randomly face up or face down. If there were no uncertainty in the orientation of the object being processed, the fifth step 20 could be omitted.

Preferably the fifth step 20 is performed using conventional automated pattern recognition equipment of a type known to those of ordinary skill in the art of automated manufacturing equipment. For example, a digital camera (not illustrated) could be coupled to a computer controller (not illustrated), providing a signal to the controller. The controller is provided with software adapted to determine from the signal the orientation of the object being processed. In particular, with respect to the coin 100, the software would recognize whether the first side 102 or second side 104 was properly oriented relative to the printing equipment. If not properly oriented, the controller would activate machinery of a type well known to those of ordinary skill in the art of automated manufacturing equipment to flip the coin 100 into the desired orientation.

Figure 6:
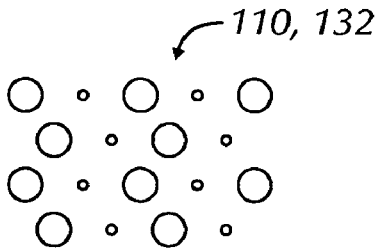
Figure 7:
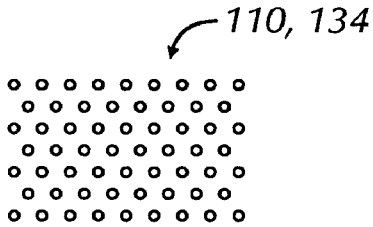
Figure 8:
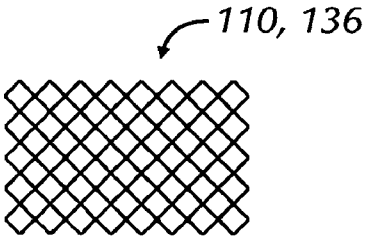
Figure 9:
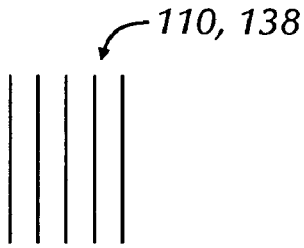
Figure 10:
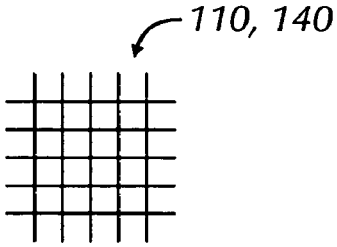
Figure 11:
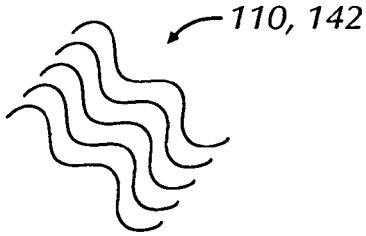
Figure 12:
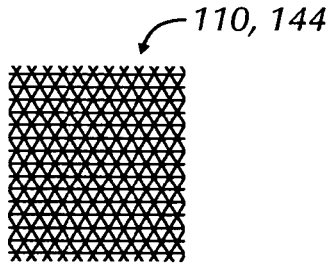
Figure 13:
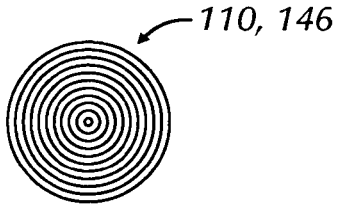

With reference now to FIGS. 1 and 6, in a sixth step 22, a first ink 116 having a first color is applied to the macropores 110 and micropores 112 to form at least one image 114 on the printable surface 108. Preferably, the first ink 116 is a solvent-based ink having a solvent which evaporates very quickly, preferably within three or four seconds of exposure to air blowing past the printable surface 108 at a moderate velocity (for example, 10 feet per second). In particular, an alcohol ketone based ink, such as the inks available from Imaje France of Bourg Les Valence, France, having product codes FT316 and 5130, have been found to be particularly effective.

The first ink 116 is preferably applied to the printable surface 108 using a first inkjet printer (not illustrated). The first inkjet printer is preferably a piezoelectric-type inkjet printer. The first inkjet printer is conventional. Preferably a Model S8 Series Master available from Image France is used.

In a seventh step 24, the ink is dried in a first air tunnel (not illustrated) where air is circulated at a moderate velocity to evaporate the solvent and dry the first ink 116. As indicated above, the metal object (preferably, the coin 100) moves through the first air tunnel in three to four seconds. The air need not be heated above the ambient temperature within the processing plant.

Preferably in an eighth step 26, a second ink 120 having a second color is applied to the macropores 110 and micropores 112 on the metal surface (the printable surface 108). The second ink 120 forms a second image 118, which preferably cooperates with the first image 114. In the particular embodiment of the coin 100 illustrated, the first image 114 and second image 118 together form a representation of a poppy flower.

Preferably, the second ink 120 is also solvent-based. It has been found to be desirable that the first and second inks 116, 120 be based on different solvents. Otherwise, when the second ink 120 is applied, the solvent contained therein tends to re-wet and blur the first image 114. The second ink 120 is preferably applied with a second inkjet printer (not illustrated) similar to the first inkjet printer (not illustrated). In a ninth step 28, the second ink 120 is air-dried, preferably in a manner similar to the first ink 116, as described in the seventh step 24.

It will be recognized that the method 10 is not limited to application of only two inks. Additional printing stations applying additional inks along with additional drying tunnels could be provided.

With reference now to FIGS. 1 and 4, in a tenth step 30, a substantially transparent top coat 122 is applied to at least substantially cover the first ink 116, and second ink 120 and other additional inks, if provided. Preferably, the top coat 122 is a substantially transparent lacquer having a nitrocellulose base resin. This lacquer is commercially available from sources including Imaje France, under the product code 5553. The preferred thickness of the top coat 122 is in the range of about 1 to 2 microns. Preferably, the tenth step 30 is performed using a third inkjet printer (not illustrated) of a type similar to the first and second inkjet printers. In an eleventh step 32, the top coat 122 is air-dried, preferably in a manner similar to that described above for the seventh and ninth steps 24 and 28.

Alternatively, it will be recognized that application of the top coat 122 could be accomplished using other materials and techniques. For example, the top coat 122 could be a transparent coating capable of being cured by exposure to ultraviolet radiation. Other types of heat sensitive top coats 122 could be used, including a polyurethane coating. Still further, the top coat 122 could either be colorless, or could be colored, while still being at least substantially transparent.

Finally, in a twelfth step 34, the first and second printed images 114, 118 are inspected for acceptable quality by automated pattern recognition equipment of a type similar to that described above relative to the fifth step 20.

It will be recognized by those of ordinary skill in the pertinent art that one or more of the foregoing twelve steps may be omitted. For example, the twelfth step 34, while desirable, need not be performed.

An efficient and low-cost method of printing images on metal surfaces is thus disclosed. In particular, an efficient and low-cost method of printing images on a face of a metal coin, wherein the image demonstrates sufficient durability and adhesion to the coin surface to make the printed coin suitable for public circulation, is disclosed.

Although the invention has been described and illustrated with respect to the exemplary embodiments thereof, it should be understood by those skilled in the art that the foregoing and various other changes, omissions and additions may be made therein and thereto, without parting from the spirit and scope of the present invention. Accordingly, reference should be made to the appended claims, rather than to the foregoing specification, as indicating the scope of the invention.

What is claimed is:

1. A method of printing on a metal surface comprising the steps of:

providing a metal surface;

forming a plurality of macropores in a designed pattern on at least a portion of the metal surface, wherein the macropores are in the range of about 0.1 to about 0.5 millimeter across;

forming a plurality of micropores within the macropores;

cleaning the metal surface;

applying a first ink having a first color to the macropores and micropores to form at least one image on the metal surface; and drying the ink.

2. The method of printing on a metal surface of claim 1, wherein the metal surface is part of a coin.

3. The method of printing on a metal surface of claim 1, wherein the step of applying the ink is performed by an inkjet printer.

4. The method of printing on a metal surface of claim 3, wherein the inkjet printer is a piezoelectric inkjet printer.

5. The method of printing on a metal surface of claim 1, wherein the ink is solvent-based.

6. The method of printing on a metal surface of claim 5, wherein the step of drying the ink includes a step of blowing air across the metal surface to evaporate a solvent in the solvent-based ink.

7. The method of printing on a metal surface of claim 1 further comprising a step of applying a second ink to the macropores and micropores on the metal surface.

8. The method of printing on a metal surface of claim 7, wherein the second ink has a second color different from the first color.

9. The method of printing on a metal surface of claim 7, wherein the first ink and the second ink are applied with first and second inkjet printers, respectively.

10. The method of printing on a metal surface of claim 7, wherein the first ink and the second ink are solvent-based, and the first ink includes a first solvent and the second ink includes a second solvent.

11. The method of printing on a metal surface of claim 1 further comprising a step of inspecting the metal surface to ensure correct orientation of the metal surface.

12. The method of printing on a metal surface of claim 11 further comprising a step of inspecting the metal surface to ensure proper quality of the printed image.

13. The method of printing on a metal surface of claim 12, wherein the steps of inspecting the metal surface and inspecting the image are performed using automated pattern recognition devices.

14. The method of printing on a metal surface of claim 1 further comprising a step of applying a substantially transparent top coat to at least substantially cover the at least one image.

15. The method of printing on a metal surface of claim 14, wherein the top coat is a substantially transparent lacquer.

16. The method of printing on a metal surface of claim 14, wherein the step of applying the top coat is performed using a third inkjet printer.

17. The method of printing on a metal surface of claim 1, wherein the macropores are in the range of about 0.01 to 0.10 millimeter deep and the spacing between the macropores is in the range of 0.0 millimeter to about 0.30 millimeter.

18. The method of printing on a metal surface of claim 1, wherein the micropores are in the range of approximately 0.01 microns to 15 microns deep.

19. The method of printing on a metal surface of claim 1, wherein the step of forming the macropores is performed in a stamping operation and the step of forming the micropores is performed in one of a sandblasting operation or a lasering operation.

20. A method of printing an image on at least a portion of a coin surface, comprising the steps of:

providing a metal coin having a first side and a second side;

forming a plurality of macropores in a designed pattern on at least a portion of the first side, wherein the macropores are in the range of about 0.1 to 0.5 millimeter across;

forming a plurality of micropores at least within the macropores;

cleaning at least the first side to provide a substantially clean surface;

inspecting the first side to ensure correct orientation of the coin;

using a first inkjet printer to apply a first ink having a first color to the macropores and micropores to form a first image on the first side;

air drying the first ink;

using a second inkjet printer to apply a second ink having a second color to the macropores and micropores;

air drying the second ink; and applying a top coat of lacquer to cover the first and second inks using a third inkjet printer.

21. The method of printing an image on at least a portion of a coin surface of claim 20 further comprising the steps of using at least a third inkjet printer to apply at least a third ink having at least a third color to the macropores and micropores and air drying the at least third ink.

22. The method of printing an image on at least a portion of a coin surface of claim 20 further comprising the step of air drying the top coat.

23. The method of printing on a metal surface of claim 1, wherein the spacing between the macropores is no more than 0.15 millimeter.

* * * * *